US005645680A

United States Patent [19]

Rietheimer

[11] Patent Number: 5,645,680

[45] Date of Patent: Jul. 8, 1997

[54] PRODUCE LABELLER

[75] Inventor: William Rietheimer, Kelowna, Canada

[73] Assignee: Systematic Packaging Controls Corporation, Kelowna, Canada

[21] Appl. No.: 469,070

[22] Filed: Jun. 6, 1995

[30] Foreign Application Priority Data

Feb. 17, 1995 [CA] Canada ..... 2142960

[51] Int. Cl.[6] ..... B65C 9/08

[52] U.S. Cl. ..... 156/567; 271/95; 271/99; 156/447; 156/568; 156/570

[58] Field of Search ..... 156/567, 568, 156/447, 570, 571, DIG. 31; 271/95, 99

[56] References Cited

U.S. PATENT DOCUMENTS

| | | | |
|---|---|---|---|
| 3,616,050 | 10/1971 | Schrotz | 156/358 |
| 4,129,473 | 12/1978 | Perrett | 156/364 |
| 4,194,941 | 3/1980 | Briggs et al. | 156/361 |
| 4,328,063 | 5/1982 | Ingalls | 156/361 |
| 4,881,934 | 11/1989 | Harston et al. | 271/95 |
| 4,896,793 | 1/1990 | Briggs et al. | 156/541 |
| 5,054,761 | 10/1991 | Dietrich et al. | 271/95 |
| 5,387,302 | 2/1995 | Bernard et al. | 156/352 |
| 5,489,360 | 2/1996 | Shimizu et al. | 156/567 |

*Primary Examiner*—Timothy McMahon
*Attorney, Agent, or Firm*—Bishop & Company

[57] ABSTRACT

A produce labeller has first and, optionally, second selectively actuable label supply cartridge for selectively supplying labels from the fast or second selectively actuable label supply cartridge to corresponding fast and second label transfer positions in a fast plane. A rotatable label transfer piston housing is provided, rotatable in the first plane on a drive shaft. The rotatable label transfer piston housing has mounted radially therein in the fast plane radially spaced apart resiliently biased radially telescoping label transfer pistons for picking up labels from the fast or second selectively actuable label supply cartridge at the fast or second label transfer position, and rotationally carrying the labels from the first or second label transfer position to a label deposit point. The labels are carried on exposed ends of the radially spaced apart resiliently biased radially telescoping label transfer pistons, one label per exposed end, by selectively actuable vacuum apertures on each exposed end.

10 Claims, 8 Drawing Sheets

PRODUCE LABELLER

FIELD OF THE INVENTION

This invention relates to the field of devices for labelling produce, and in particular to devices for automatically labelling produce moving on a conveyor by means of a rotary label transfer apparatus.

BACKGROUND OF THE INVENTION

In the prior art, applicant is aware of an electrically driven produce labeller manufactured by Sinclair International of the United Kingdom. The device relies on bellows selectively positionable between retracted and extended position for applying self-adhesive labels to produce moving on a conveyor. The device suffers from mechanical complexity. The device does not allow for automated switching between multiple labellers. The device may not be adjusted to regulate the pressure with which a label is applied.

Thus it is an object of the present invention to provide a produce labeller which does not rely on a bellows mechanism, but rather, relies on at least one cam surface in a non-rotating cam surface hub guiding spring-biased, piston-type label applicators in a radially spaced array on a rotating plate, actuation of the piston-type applicators between retracted and extended positions governed by at least one cam surface within the non-rotating cam surface hub, and wherein the spring biasing force may be adjusted to adjust the pressure applied to units of produce when labelling.

It is a further object of the present invention to provide for a transverse array of such produce labeller devices along a common drive shaft so as to rotate each plate housing the piston-type label applicators in the transverse array.

The device according to the objects of the present invention accomplish a reduction in mechanical complexity and, in particular, remove the complexity associated with pneumatically sealing a pneumatically assisted device by means of a seal provided between a rotating plate and a non-rotating hub. This is accomplished, in particular, by the me of Delrin (TM) material on the beating surfaces between the plate and hub.

SUMMARY OF THE INVENTION

A produce labeller has first and, optionally, second selectively actuable label supply means for selectively supplying labels from the first or second selectively actuable label supply means to corresponding first and second label transfer positions in a first plane. A rotatable label transfer means housing is provided, rotatable in the first plane on a drive shaft. The rotatable label transfer means housing has mounted radially therein in the first plane radially spaced apart resiliently biased radially telescoping label transfer means for picking up labels from the first or second selectively actuable label supply means at the first or second label transfer position, and rotationally carrying the labels from the first or second label transfer position to a label deposit point. The labels are carded on exposed ends of the radially spaced apart resiliently biased radially telescoping label transfer means, one label per exposed end, by selectively actuable vacuum means on each exposed end.

Cam means is provided in a second plane adjacent and parallel to the first plane. The cam means moves the radially spaced apart resiliently biased radially telescoping label transfer means between a retracted label pick up position at the first and second label transfer positions and an extended label deposit position at the label deposit point. Cam followers on the radially spaced apart resiliently biased radially telescoping label transfer means cooperate with the cam means.

Advantageously, the cam means has a fixed cam surface housing and the selectively actuable vacuum means includes first vacuum ports on the exposed ends communicating via vacuum communication means with a vacuum plenum in the rotatable label transfer means housing.

The rotatable label transfer means housing is mounted snugly adjacent the fixed cam surface housing so as to bear a first planar surface on the rotatable label transfer means housing snugly against a second planar surface on the fixed cam surface housing. The vacuum plenum has a vacuum plenum aperture on the first planar face cooperating with a vacuum manifold in the fixed cam surface housing via an arcuate aperture on the second planar face. The vacuum manifold arcuate aperture extends between a vacuum initiating point, corresponding to the location of the vacuum plenum aperture when the fast vacuum port has been rotated in the first rotational direction on the rotatable label transfer means housing to the first label transfer position, and a vacuum removal point corresponding to when the first vacuum port has been rotated in the first rotational direction on the rotatable label transfer means housing to a point past the label deposit point.

When the first vacuum port is at the first label transfer position the vacuum plenum aperture corresponds to the vacuum initiating position on the vacuum manifold arcuate aperture. A vacuum applied to the vacuum manifold is thereby communicated to the first vacuum port and maintained as the rotatable label transfer means housing is rotated in the first rotational direction so as to rotate the first vacuum port from said first label transfer position to said label deposit point. As the first vacuum port is rotated in the first rotational direction past the label deposit point, the vacuum plenum aperture is rotated out of corresponding alignment with the vacuum removal point on the vacuum manifold arcuate aperture so as to remove communication of the vacuum in the vacuum manifold with the fast vacuum port.

Further advantageously, the distance between the fast label transfer position and the label deposit point, when measured in the fast rotational direction, is less than the distance between the second label transfer position and the label deposit point when measured in the first rotational direction. The first and second selectively actuable label supply means have first and second label magazines for housing corresponding first and second linear arrays of linearly aligned self-adhesive labels releasably mounted on fast and second linear label backing webs. The first and second selectively actuable label supply means further have corresponding first and second selectively actuable label web drive means such as electric stepper motors for pulling the linear label backing web from the corresponding first and second label magazines, around corresponding label separating edges of corresponding flanges extending from the fast and second label magazines over the corresponding first and second label transfer positions so as to separate corresponding self-adhesive labels from corresponding fast and second linear label backing webs at fast and second label transfer positions.

When the fast selectively actuable label web drive means is selectively actuated fast linear label backing web is pulled around the fast label separating edge of the fast flange by the fast label web drive means. The first linear array of self-adhesive labels are thus sequentially separated from their backing web and exposed for transfer to the exposed ends of the radially telescoping label transfer means as the exposed ends are rotated onto the fast label transfer position for carriage of the labels on the exposed ends by means of the vacuum communicated through the first vacuum ports.

When the second selectively actuable label web drive means is selectively actuated the second linear label backing web is pulled around the second label separating edge of the second flange by the second label web drive means and the second linear array of labels are sequentially separated and exposed for transfer to the exposed ends, and carriage of the labels on the exposed ends by means of the vacuum communicated through the fast vacuum ports so long as the fast selectively actuable label web drive means has not been selectively actuated.

In the preferred embodiment, the resiliently biased radially telescoping label transfer means are a plurality of radially spaced apart spring biased piston lying in the first plane telescopingly housed in corresponding radially spaced apart cylinders in the rotatable label transfer means housing. The radially spaced apart cylinders have corresponding radially extending elongate apertures extending through the first bearing surface. The radially spaced apart pistons have corresponding cam followers mounted rigidly thereon which extending from the pistons through the elongate aperatures in the fast beating surface.

The cam means includes a cam surface in the second bearing surface against which are urged the cam followers by the springs. The cam surface constrains the cam followers in a generally circular arc so as to maintain the pistons in their retracted label pickup position as the rotatable label transfer means housing is rotated in the first rotational direction so as to rotate a first piston between the first label transfer pickup position and the label deposit point. The cam surface extending radially outward from the generally circular arc at the label deposit point, whereby the first piston extends radially under the spring biasing force of its spring to the corresponding extended label deposit position at the label deposit point.

Further advantageously in the preferred embodiment, the drive shaft, which is journalled through the fixed cam surface housing, is mounted transversely across and above a produce conveyor moving articles of produce from an upstream position to a downstream position underneath the label deposit point. At the label deposit point a self-adhesive label, carried on the exposed end of the fast piston by means of the vacuum communicated through the first vacuum port, may be transferred to the surface of the article of produce under the label deposit point by means of the spring biasing force acting on the first piston. When the piston is extended, the label is pressed against the surface of the article of produce to thereby adhere the label to the surface.

The produce conveyor may include an upstream sensor means for detecting whether a sensed article of produce sensed by the sensor means requires either a first label from the first selectively actuable label supply means or a second label from the second selectively actuable label supply means. The sensor means generates a signal and communicates the signal to either the first or second selectively actuable label supply means so as to actuate either the first or second selectively actuable label web drive means. Thereby either the first label or the second label is transferred to the exposed end of the first piston in a timed fashion. The rotation of the first or second label on the rotatable label transfer means housing from the first or second label transfer position to the label deposit point coincides with a coinciding timed arrival of the sensed article of produce.

DETAILED DESCRIPTION OF THE PREFERRED EMBODIMENT

Figure 1:
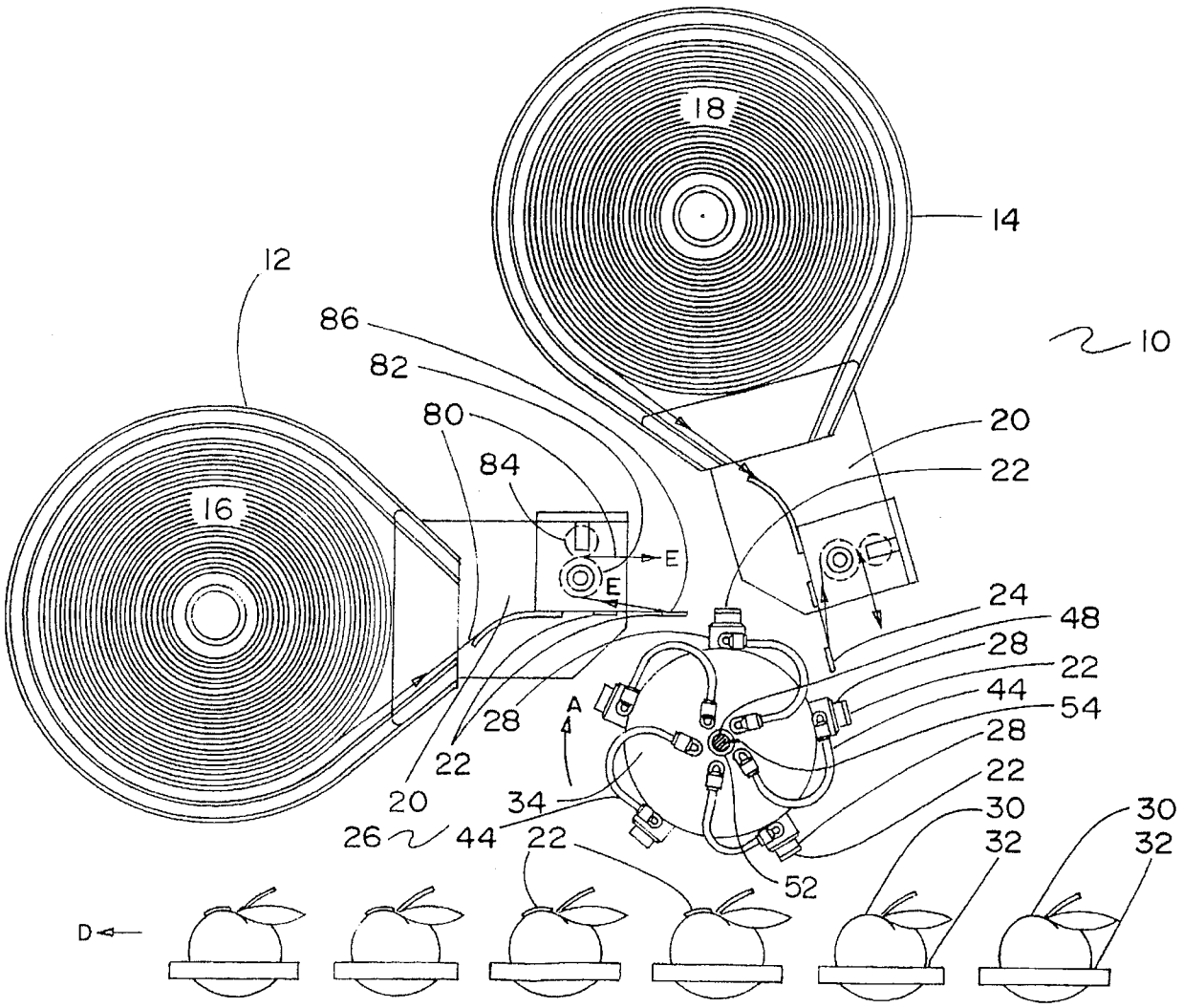
FIG. 1 is, in partial cutaway side elevation view, the produce labeller of the present invention along line 1—1 in FIG. 2.

As illustrated in FIG. 1, labeller 10 has label magazines 12 and 14 which when mounted, as in the form of a cartridge, onto labeller 10 feed labels from rolls of labels 16 and 18 respectively through identical label feed mechanisms 20 so as to position individual labels 22 and 24 ready for pickup by label pickup and transfer device 26. Label pickup and transfer device 26 picks up either individual labels 22 or individual labels 24 on transfer heads 28. Labels 22 or 24 on transfer heads 28 are transferred into proximity with produce 30 on conveyor 32 by means of rotation of turret plate 34 in direction A.

Figure 2:
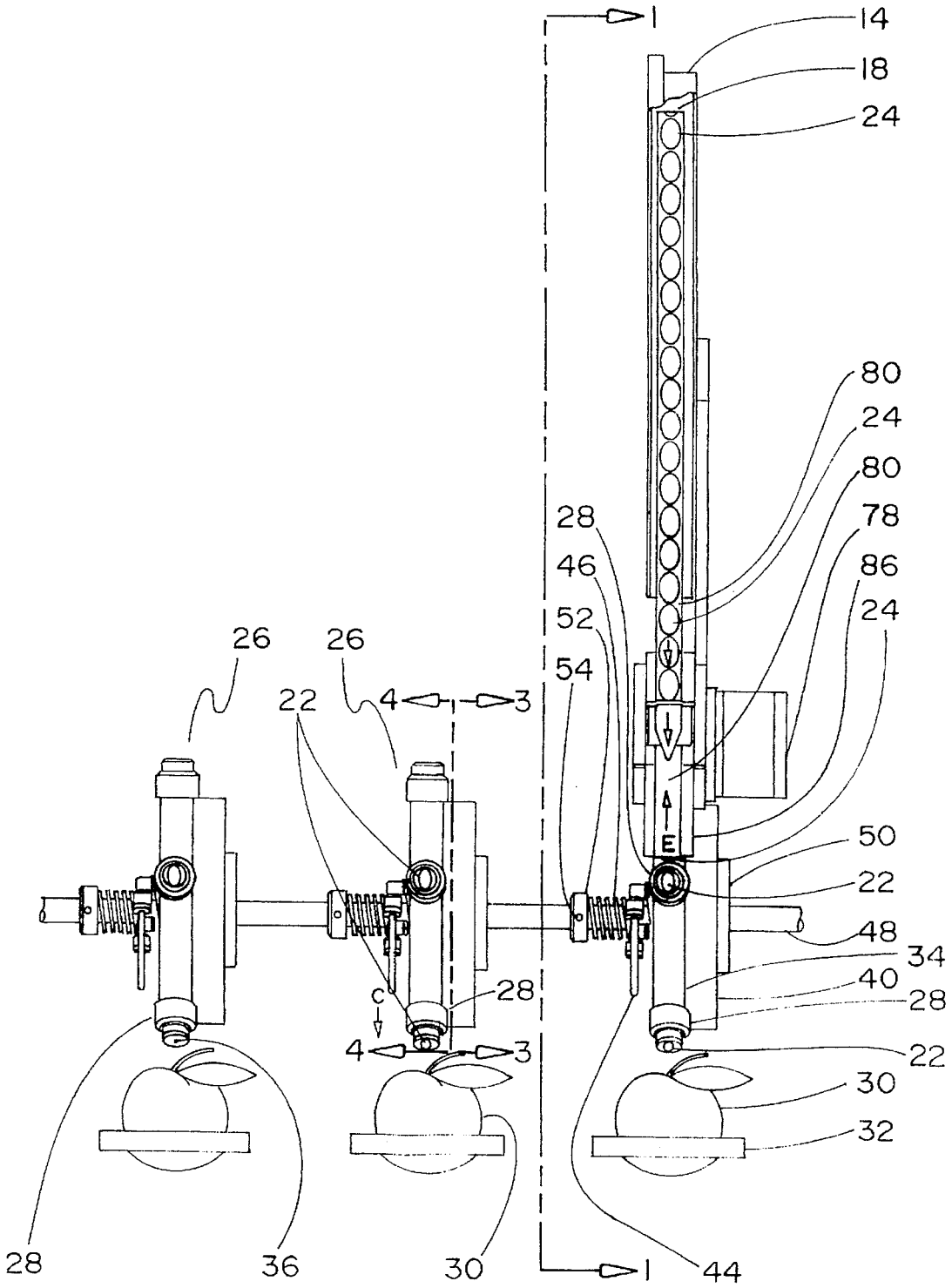
FIG. 2 is, in partial cutaway front elevation view, the produce labeller of FIG. 1.

As illustrated in FIG. 2, a transverse array of label pickup and transfer devices 26 may be rotatably mounted on a common drive shalt 48 transversely across conveyor 32. Although not illustrated, each label pickup and transfer device 26 would have corresponding label magazines 12 and 14.

The means by which either labels 22 or labels 24 are adhered to transfer heads 28 for transport from label feed mechanisms 20 into proximity with produce 30, is the application of a vacuum to vacuum port 36 on transfer heads 28. A vacuum is applied to vacuum port 36 from a common vacuum source (not shown) via vacuum conduit 37 and vacuum manifold 38 seen in FIG. 3 in non-rotating cam surface hub 40, and vacuum transfer ports 42 on turret plate 34 as seen in FIG. 4. Vacuum lines 44 and vacuum transfer manifolds (not shown) in transfer heads 28 communicate a vacuum between vacuum transfer ports 42 and vacuum ports 36.

Turret plate 34 and non-rotating cam surface hub 40 may be made of Delrin (TM) or like material so long as turret plate 34 may be easily rotated over non-rotating cam surface hub 40, and form a pneumatic seal therebetween, when turret plate 34 is forced against non-rotating cam surface hub 40 by spring 46. Non-rotating cam surface hub 40 is rigidly mounted on drive shaft 48 by means of mounting plate 50 or the like. Spring 46 may be mounted on drive shaft 48 so as to be compressed against turret plate 34 by means of spring mounting collar 52 secured on chive shaft 48 by means of screw 54 or like fastener. The use of Delrin (TM) or like material allows for relatively frictionless rotation of turret plate 34 against non-rotating cam surface hub 40 while maintaining a relatively airtight seal therebetween so as to transfer a vacuum between vacuum manifold 38 and vacuum transfer ports. 42 when vacuum manifold 38 and vacuum transfer ports 42 are aligned.

Transfer heads 28 are mounted on pistons 56. Pistons 56 are journalled in a planar radially spaced array of piston receiving cylinders 58 in turret plate 34 so that pistons 56 when mounted in cylinders 58 protrude from the outer circumference of turret plate 34. Pistons 56 when mounted in cylinders 58 are spring biased by helical springs 60 so that each piston 56 is urged in a radially outward direction from corresponding cylinders 58. Pistons 56 are removable from cylinders 58 upon removal of cam followers 62 from pistons 56. Pistons 56 are removable to allow for removal of helical springs 60. Helical springs 60 are removable so as to be interchangeable with helical springs of different strength if it is desired to adjust the spring force of helical springs 60.

Cam followers 62 are removably rigidly affixed to pistons 56 and extend from cylinders 58 through elongate apertures 64 on turret plate 34. Cam followers 62 protrude from bearing surface 66 on turret plate 34. Beating surface 66 on turret plate 34 bears against corresponding beating surface 68 on non-rotating cam surface hub 40. Cam followers 62 are constrained by cam surface 70 to move in cavity 72 in non-rotating cam surface hub 40 so as to follow cam surface 70 in direction B when turret plate 34 rotates in direction A.

Figure 5:
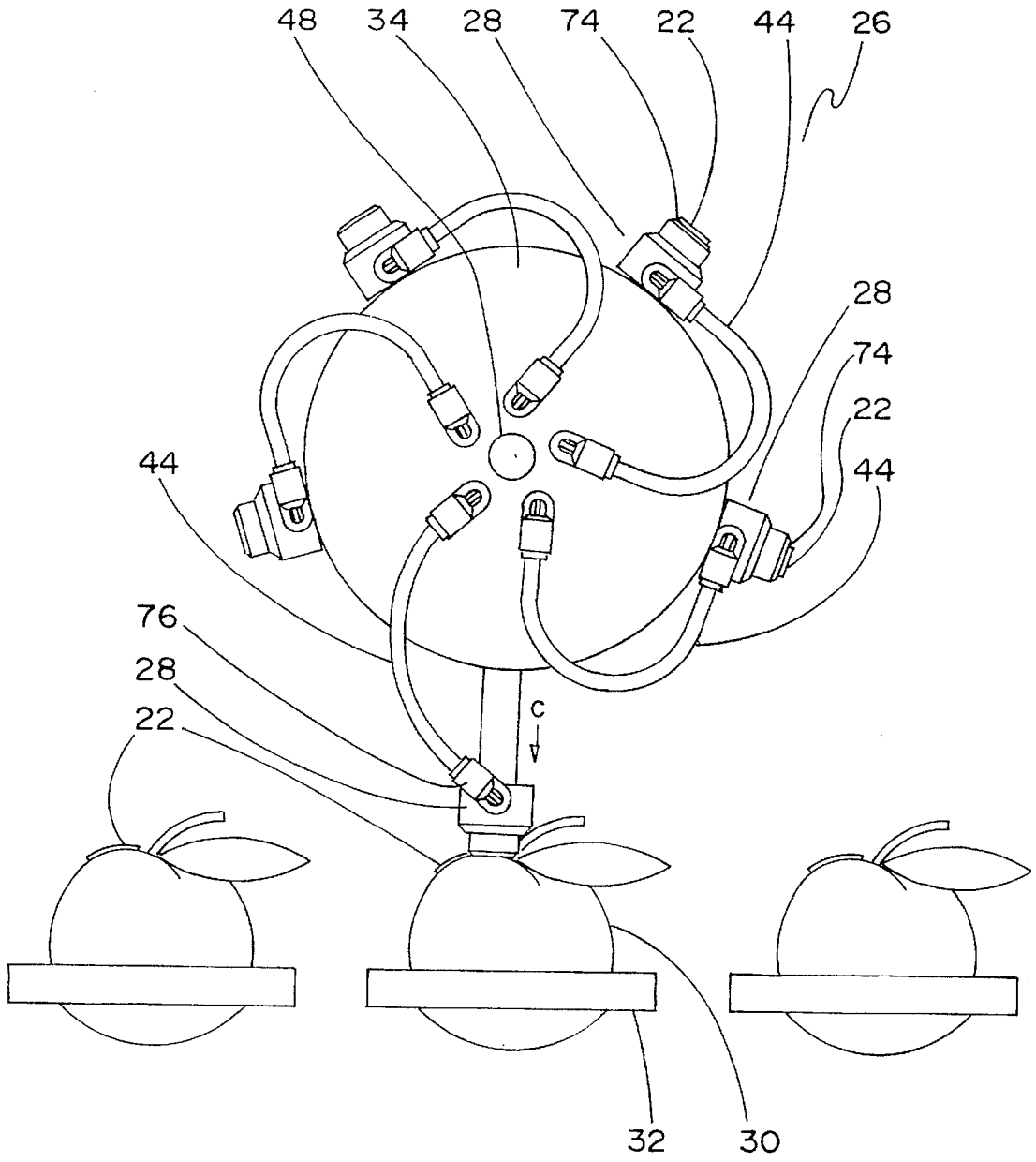
FIG. 5 is a side elevation view of the label pickup and transfer device of the produce labeller of the present invention.
Figure 6:
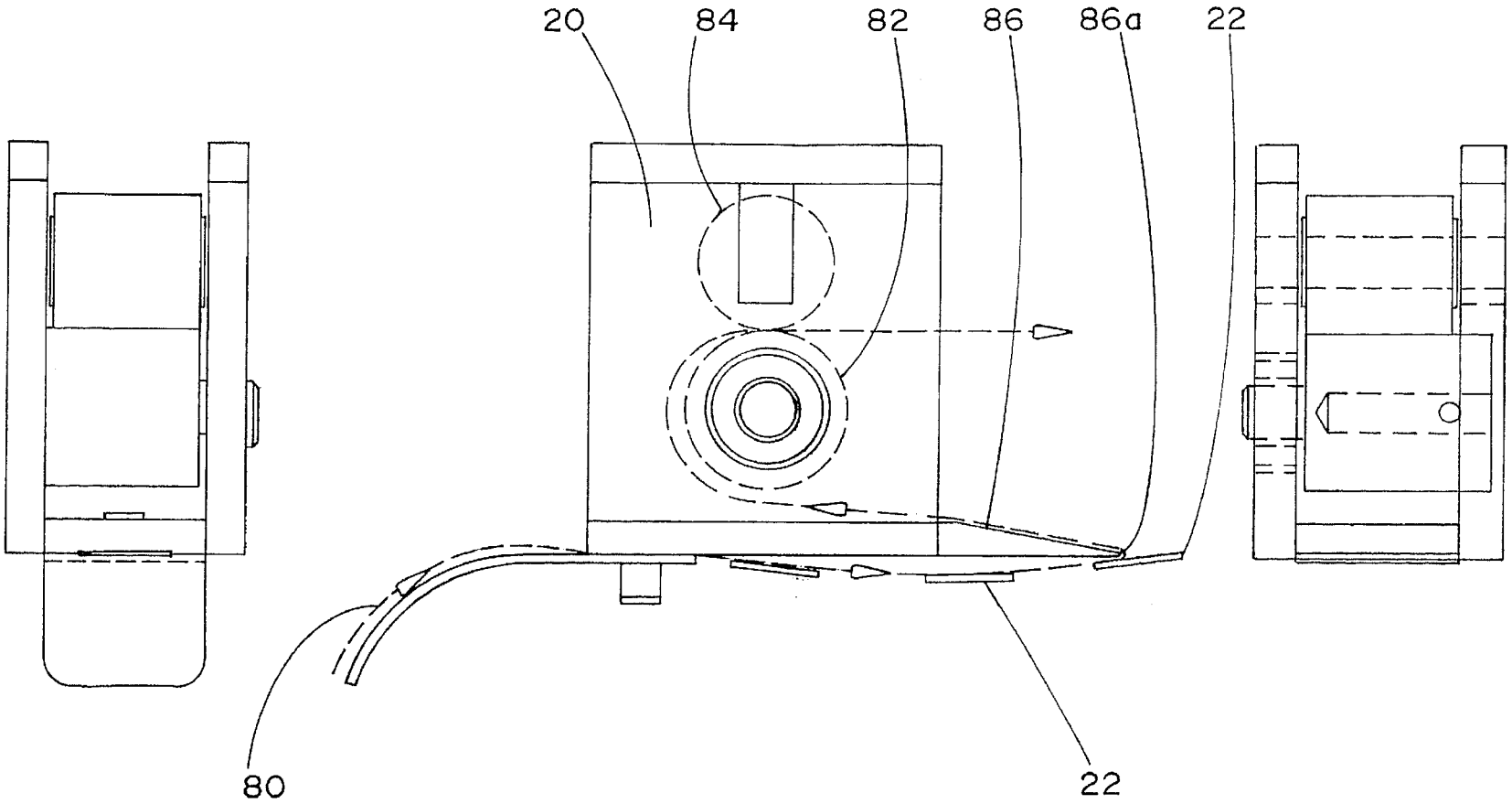
FIG. 6 is an enlarged view of a label feed mechanism depicted in FIG. 1.

Thus, as turret plate 34 rotates in direction A, cam follower 62 likewise rotates in direction B on cam surface 70 under the radially outward spring biased force of helical spring 60. As transfer heads 28 come into proximity with produce 30 cam surface 70 at that label deposit point curves abruptly radially outwards to thereby allow piston 56 to extend from cylinder 58 in direction C so as to impact transfer head 28 against the surface of corresponding produce 30 as illustrated in FIG. 5. As piston 56 is forced from cylinder 58 in direction C vacuum line 44 flexes. It is understood that other means to allow for flexing may be incorporated, as for example by robotic fittings. Vacuum line 44 may be pivotally mounted at its ends so as to allow rotation of vacuum line heads 76 on transfer head 28.

Transfer heads 28 may have foam applicator pads 74 so as to cushion the force of transfer heads 28 being impacted against the surface of produce 30. If a label 22 or label 24 has been transferred from a label feed mechanism 20 onto a transfer head 28 and carded by that transfer head 28 into contact with the surface of produce 30, the self-adhesive surface of label 22 or 24 (whichever label was caused to supplied), which self-adhesive surface is exposed outwardly from transfer head 28, contacts the surface of produce 30 and label 22 or label 24 is adhered thereby to the surface of produce 30 as produce 30 on conveyor 32 is conveyed in direction D.

Stepper drive motors 78 on label feed mechanisms 20 control the feed of the labels 22 or labels 24 from label roll 16 or label roll 18 respectively. If a label of a type housed in label magazine 12 is desired for a certain unit of produce 30 moving in direction D on conveyor 32 then stepper drive motor 78 corresponding to the label feed mechanism 20 on magazine 12 is selectively activated to pull label roll web 80 in direction E by means of drive roller 82 trapping label roll web 80 between drive roller 82 and idler roller 84. Once label roll web 80 has been pulled by drive roller 82 so as to be pulled between drive roller 82 and idler roller 84, label roll web 80 is expelled as waste and may be extracted such as by means of a vacuum robe (not shown) or the like. Label roll web 80 serves as a storage and transfer medium for self-adhesive labels 22. It is understood that an identical mechanism for storing and transferring labels 24 is used in association with label magazine 14 and its corresponding label feed mechanism 20. Label roll web 80 carrying labels 22 is fed from roll 16 in magazine 12 first under flange 86 and then in a reverse direction back over flange 86 towards drive roller 82. Drive roller 82 pulls label roll web 80 around the blunt edge **86*a* of flange 86. Labels 22 are releasably mounted to the lower-most surface of label roll web 80 (when viewed passing under flange 86) by their self-adhesive backing. Drawing label roll web 80 under flange 86 and backwards over blunt edge 86*a* of flange 86 draws labels 22 along the underside of flange 86 so as to extend a label 22 from blunt edge 86*a*. The self-adhesive backing of labels 22 does not sufficiently adhere labels 22 to label roll web 80 to enable label 22 to be pulled back over the blunt edge 86*a* in the manner of label roll web 80. Label 22, instead of following the path of label roll web 80, separates from label roll web 80 and extend outwards from the blunt edge 86*a*, ready for transfer onto transfer heads 28**.

Transfer heads 28 on turret plate 34, and in particular vacuum ports 36, are rotated in direction A to a position on a single transfer head 28 under label 22 as it extends from the blunt edge **86*a* of flange 86. At this position, a vacuum transfer port 42, corresponding to the transfer head 28 in the vertical position, becomes aligned with vacuum manifold 38 so that a vacuum is applied to vacuum port 36 adhering the non-adhesive side of label 22 against the transfer head 28**.

As turret plate 34 continues rotating in direction A, the vacuum transfer port 42 corresponding to the transfer head 28 now carrying label 22 rotates in a circular arc over vacuum manifold 38 so as to thereby maintain the vacuum applied to the corresponding vacuum port 36. Label 22 is thus held against transfer head 28 as transfer head 28 is rotated from an upper vertical position to a lowered generally vertical deposit position (ie. having been rotated approximately 180 degrees) in proximity to produce 30. The vacuum applied to vacuum port 36 is maintained as transfer head 28 is rotated through the lowered deposit position in proximity to produce 30.

Figure 3:
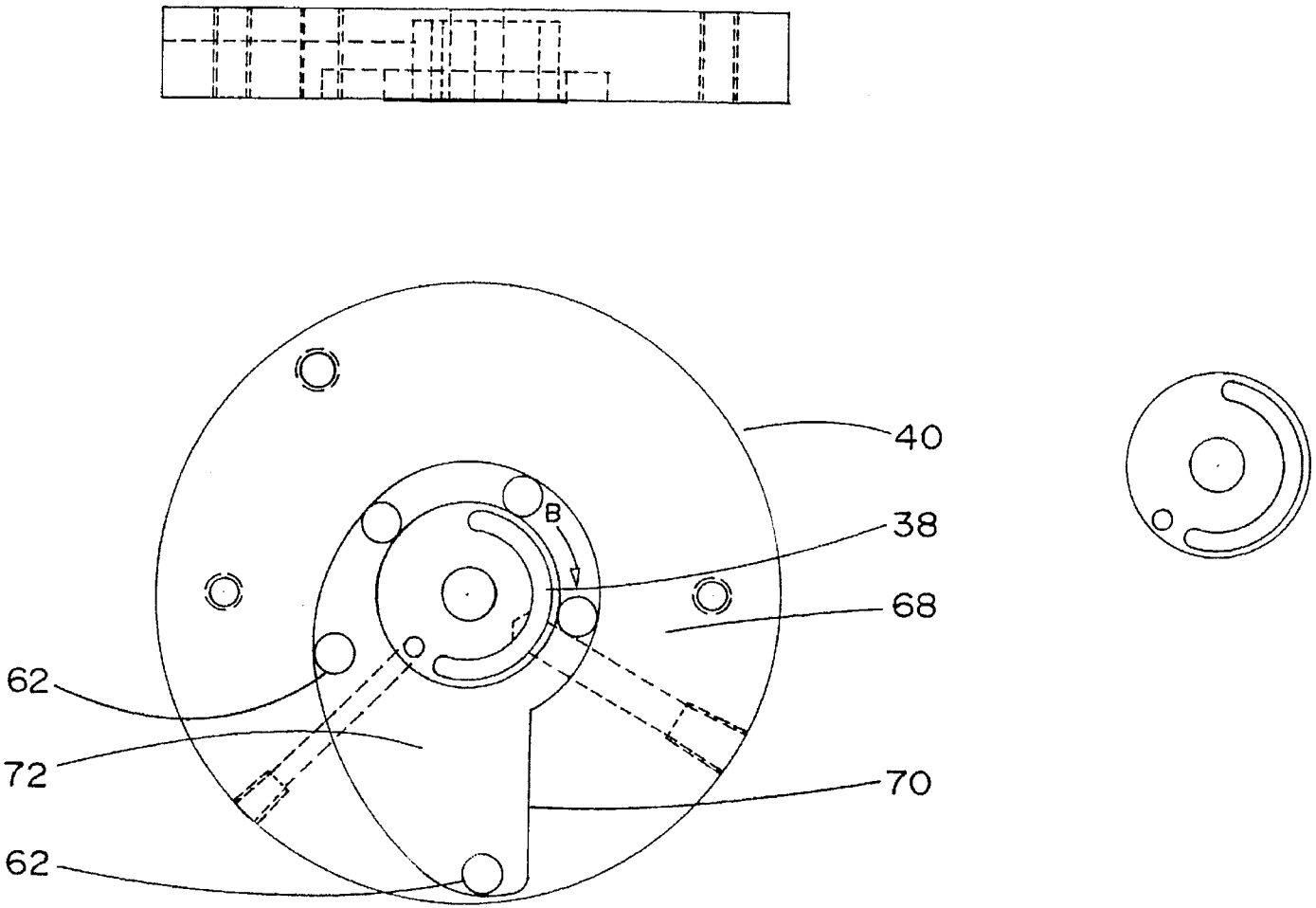
FIG. 3 is a cross-sectional view along line 3—3 in FIG. 2.
Figure 4:
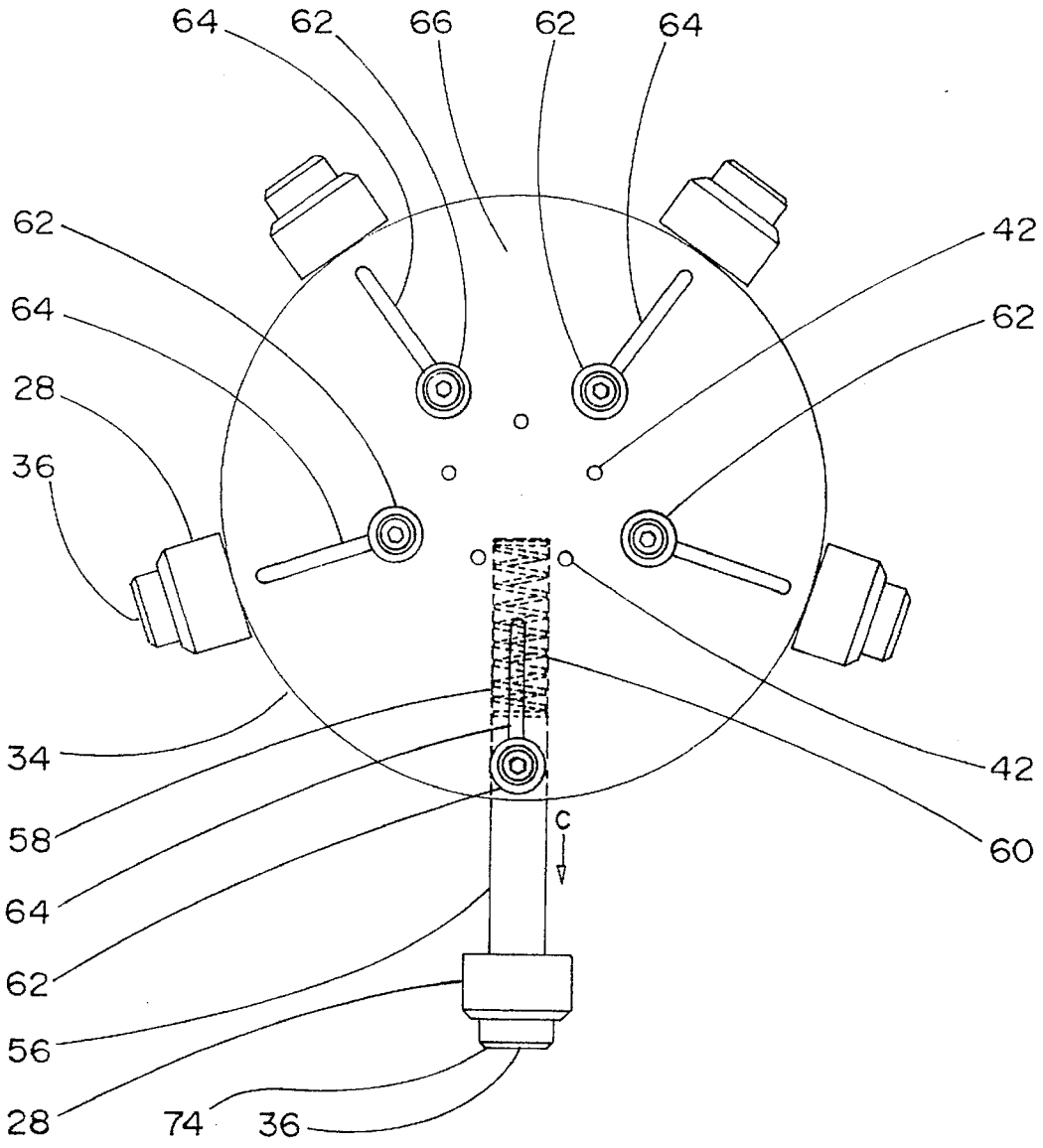
FIG. 4 is a cross-sectional view along line 4—4 in FIG. 2 with transfer head 28 extended in direction C from that view shown in FIG. 2.

As seen in FIG. 3, as turret plate 34 continues to rotate in direction A, transfer head 28, having transferred label 22 onto produce 30, is retracted by the action of its cam follower 62 continuing to move in direction B so as to follow cam surface 70 in a radially retracting curve as transfer head 28 is returned to its upper vertical position. Piston 56 is thereby forced to retract into cylinder 58 against the return biasing force of spring 60. The rate of retraction of piston 56 is governed by the rate of incline of cam surface 70. The rate of incline, that is, the rate of retraction of piston 56, governs the dwell time that transfer head 28 remains in contact with produce 30. Dwell time is also affected by the diameter of the produce being labelled. Smaller units of produce 30 will have lesser dwell times than larger units of produce 30. Generally, it is desirable to reduce the dwell time so that labels are quickly applied and transfer heads quickly retracted so as not to disturb, for example, roll, produce 30 on conveyor 32.

As turret plate 34 moves in this manner in direction A so as to retract piston 56 into cylinder 58 and return transfer head 28 to the vertical, corresponding vacuum transfer port 42 moves out of alignment with vacuum manifold 38 and the vacuum is thereby removed from vacuum port 36. In the event that label 22 did not adhere to the surface of produce 30, for example, if produce 30 was misshapen resulting in label 22 being carded on transfer head 28 past the deposit position, then label 22 is ejected from transfer head 28 (in case it has not fallen off upon removal of the vacuum) as it begins its upward movement in direction A by means of pressurized air applied via channel 43 and pressure port 45 to vacuum transfer port 42. In this manner, label 22 is not inadvertently carried by transfer head 28 so as to foul the next label pickup cycle.

Figure 7:
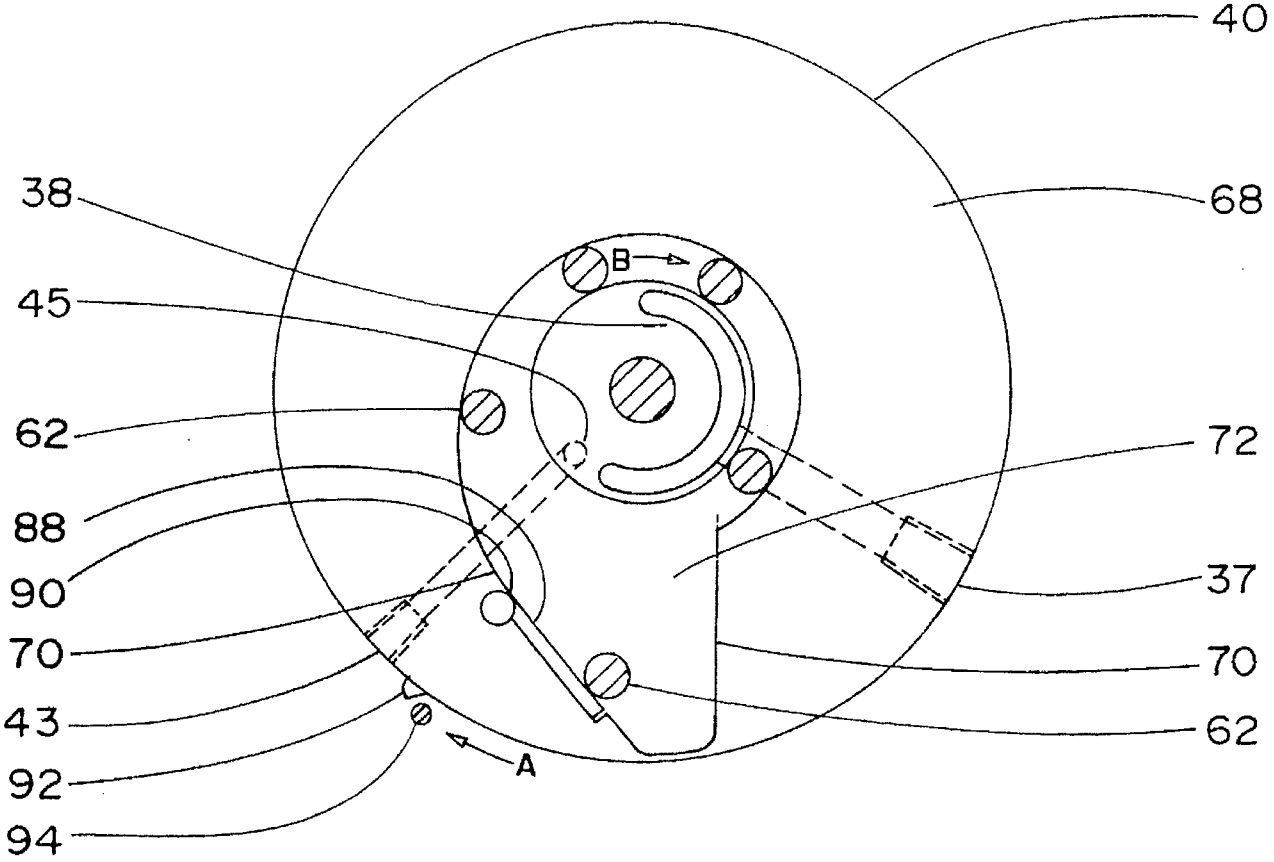
FIG. 7 is an alternative embodiment of the device of FIG. 3.
Figure 8:
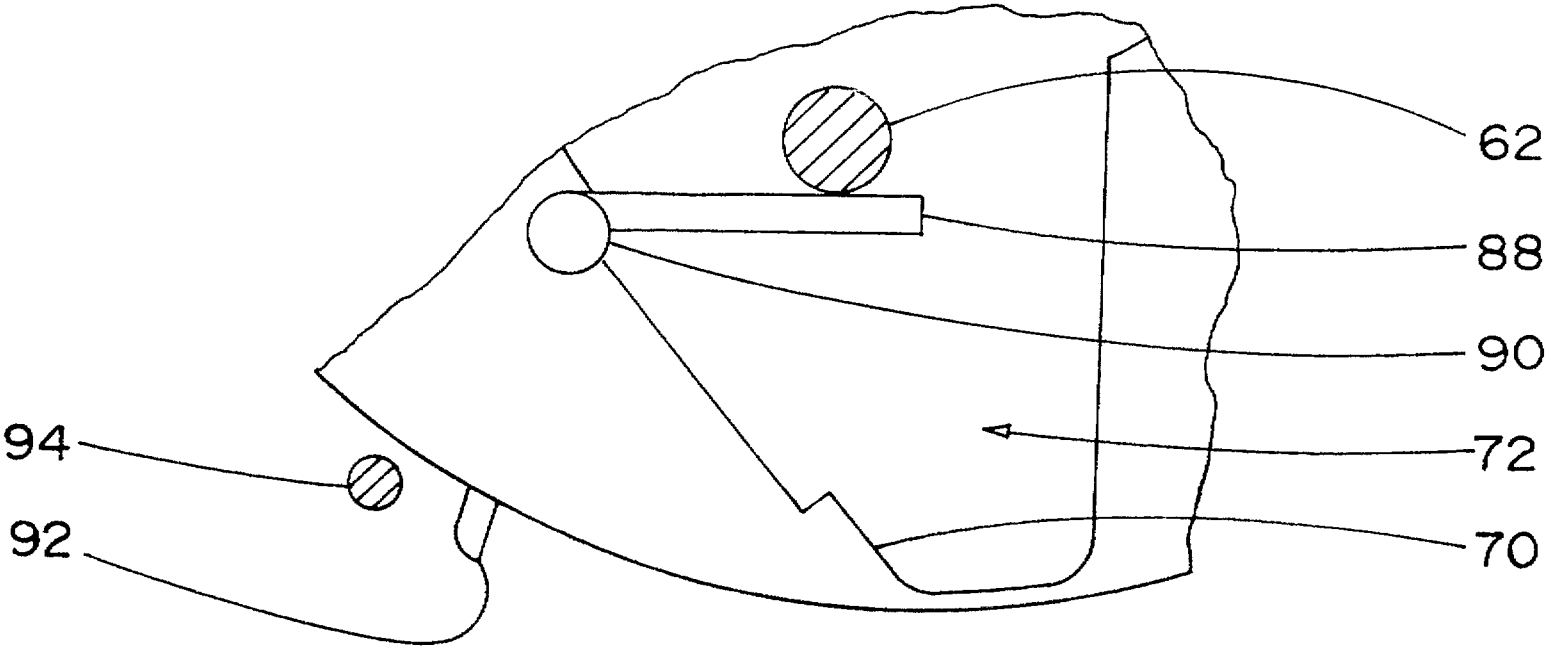
FIG. 8 is an enlarged view of the secondary cam of FIG. 7.

In a further embodiment, as depicted in FIG. 7, secondary cam 88 forms an independently rotatable part of cam surface 70 in the manner of a piston return lever on the inclined slope of cam surface 70 causing piston 56 to retract into cylinder 58. Secondary cam 88 is a spring biased lever (lever spring not shown) which is rotatable about lever hinge 90 so as to forcibly raise cam followers 62, a cam follower 62 shown raised by secondary cam 88 in FIG. 8. Trigger 92, which may be of resilient material, is connected to lever hinge 90 so that movement of trigger 92 in direction A lowers secondary cam 88 against the return biasing force of the lever spring. Trigger 92 may be moved in direction A by pins 94 or the like extending from turret plate 34 parallel to cam followers 62 when, as turret plate 34 is rotated in direction A, pins 94 engage and drag trigger 92. Each one of pistons 56 would have a corresponding pin 94 (although only one is shown) to cock secondary cam 88, pins 94 spaced sufficiently in advance of their corresponding pistons 56 so that trigger 92 is released once corresponding cam follower 62 is riding over secondary cam 88. The spacing of pins 94 in advance of their corresponding pistons 56 regulates the delay between the extension and retraction of pistons 56, ie. dwell time of transfer heads 28 on produce 30.

Label roll 18 in label magazine 14 provides an optional supply of produce labels which may be selectively transferred onto produce 30 instead of produce labels from magazine 12. An example of when this is desirable is when produce 30 is known to fall into two weight ranges. Labels from label roll 16 would thus indicate one weight range and labels from label roll 18 would indicate a second weight range. Units of produce 30 moving in direction D on conveyor 32 would be weighed by a weight-sensor (not shown) upstream of labeller 10 and a timed signal sent to labeller 10 from the weight sensor to indicate which weight range each unit of produce 30 fell within. Thus the correctly corresponding label for the weight range of a particular unit of produce 30 would be selected and transferred to the correctly corresponding transfer head 28. Thus as that particular unit of produce 30 came into its labelling position underneath turret plate 34 the corresponding transfer head 28 will have picked up the correct label, either label 22 or label 24 for transfer onto that unit of produce 30.

A further example of when it would be useful to have an optional supply of produce labels in label magazine 14 is in the case where only a single type of produce label is desired, so that labels are label rolls 16 and 18 are identical so that label magazine 14 may be used as a back-up label supply to label magazine 12. In this application, a sensor (not shown) would be placed between label feed mechanisms 20 on label magazines 12 and 14 so as to sense if a label 22 had been successfully transferred to a transfer head 28 passing in direction A through the upper vertical position. In the event that a label 22 was not transferred onto a transfer head 28, for example, if the feed mechanism became fouled, then a signal would be sent to stepper drive motor 78 on label feed mechanism 20 corresponding to magazine 14 so as to extend a label 24 into the path of vacuum port 36 on the transfer head 28 having just passed the sensor in direction A. In this manner, an automated back-up label supply would assure continued operation without manual intervention in the event of a failure of the supply of labels from label magazine 12.

When it is desired for a particular transfer head 28 to transfer a label 24 rather than a label 22 the stepper drive motor 78 corresponding to the label feed mechanism 20 on the magazine 14 is actuated so as to extend the label 24, rather than actuating the stepper drive motor 78 on the label feed mechanism 20 corresponding to label magazine 12. Thus as the transfer head 28 which is to pick up a label 24 is rotated in direction A into an upper vertical position, a label 22 has not been advanced from blunt edge **86*a* for pickup from flange 86, but rather a label 24 has been advanced from magazine 14 for pickup from flange 86 on label feed mechanism 20 corresponding to label magazine 14**.

When it is desired to change label magazines 12 or 14 so as to differently label produce 30, magazine 12 or 14 and their corresponding label feed mechanisms 20 may be removed as a unit from their supporting frames (not shown) and a new preloaded magazine and corresponding feed mechanism 20 inserted in their place. Empty label magazines may be changed in this manner. Changing of label magazines may be accomplished quickly as the label magazines and their corresponding feed mechanisms 20 are not physically coupled to the label pickup and transfer device 26.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A produce labeller comprising:

first and second selectively actuable label supply means for selectively supplying labels from said first or second selectively actuable label supply means to corresponding first and second label transfer positions in a first plane, a rotatable label transfer means housing, selectively rotatable in said fast plane in a first rotational direction by rotation means, said rotatable label transfer means housing having mounted therein in said first plane, a resiliently biased radially telescoping label transfer means for picking up a label from said first or second selectively actuable label supply means at said fast or second label transfer position and rotationally carrying said label for said first rotational direction from said first or second label transfer position to a label deposit point, said label carried on an exposed end of said resiliently biased radially telescoping label transfer means by a selectively actuable vacuum means mounted on said exposed end, cam means in a second plane parallel to said first plane for moving in a radial direction said resiliently biased radially telescoping label transfer means between a retracted label pick-up position at said first and second label transfer positions and an extended label deposit position at said label deposit point, said first plane adjacent to said second plane and said resiliently biased radially telescoping label transfer means having cam follower means cooperating with said cam means, wherein said cam means comprises a fixed cam surface housing and said selectively actuable vacuum means comprises a first vacuum port in said exposed end communicating via vacuum communication means with a vacuum plenum in said rotatable label transfer means housing, said rotatable label transfer means housing mounted adjacent said fixed cam surface housing so as to bear a planar first bearing surface on said rotatable label transfer means housing against a planar second bearing surface on said fixed cam surface housing, said vacuum plenum having a vacuum plenum aperture on said first bearing surface, said vacuum plenum aperture cooperating with a vacuum manifold in said fixed cam surface housing, via an arcuate aperture on said second bearing surface, said vacuum plenum aperture corresponding to said arcuate aperture, said arcuate aperture extending between a vacuum initiating point, corresponding to the location of said vacuum plenum aperture when said first vacuum port has been rotated in said first rotational direction on mid rotatable label transfer means housing to said first label transfer position, and a vacuum removal point corresponding to when said first vacuum port has been rotated in said first rotational direction on said rotatable label transfer means housing to a point past said label deposit point, whereby, as said rotatable label transfer means housing is rotated by said rotation means in said first rotational direction relative to said fixed cam surface housing, when said first vacuum port is at said first label transfer position said vacuum plenum aperture corresponds to said vacuum initiating position on said arcuate aperture and a vacuum applied to said vacuum manifold is communicated to said first vacuum port and maintained as said rotatable label transfer means housing is rotated in said first rotational direction so as to rotate said first vacuum port from said first label transfer position to said label deposit point, and whereby, as said first vacuum port is rotated in said first rotational direction past said label deposit point, said vacuum plenum aperture is rotated out of corresponding alignment with said vacuum removal point on said arcuate aperture so as to remove communication of said vacuum in said vacuum manifold with said first vacuum port thereby to release a label releasably carried on said exposed end.

2. The device of claim 1 wherein the distance between said first label transfer position and said label deposit point, when measured in said first rotational direction, is less than the distance between said second label transfer position and said label deposit point when measured in said first rotational direction, and wherein said first and second selectively actable label supply means comprise first and second label magazines for housing corresponding first and second linear arrays of linearly aligned self-adhesive labels releasably mounted on first and second linear label backing webs, said first and second selectively actuable label supply means further comprising corresponding first selectively actuable label web drive means and second selectively actuable label web drive means for pulling said first and second linear label backing webs from corresponding said first and second label magazines, around corresponding label separating edges of corresponding flanges extending from said first and second label magazines over corresponding said first and second label transfer positions so as to separate corresponding self-adhesive labels from corresponding said first and second linear label backing webs at said first and second label transfer positions, whereby when said first selectively actuable label web drive means is selectively actuated said first linear label backing web is pulled around said first label separating edge of said first flange by said first label web drive means, and said first linear array of self-adhesive labels are sequentially separated and exposed for transfer of a label to said exposed end and carriage of aid label on said exposed end by means of said vacuum communicated through said first vacuum port, and whereby when said second selectively actuable label web drive means is selectively actuated instead of said first selectively actuable label web drive means said second linear label backing web is pulled around said second label separating edge of said second flange by said second label web drive means and said second linear array of labels are sequentially separated and exposed for transfer of a label to said exposed end and carriage of said label on said exposed end by means of said vacuum communicated through said first vacuum port.

3. The device of claim 2 wherein said resiliently biased radially telescoping label transfer means comprise a plurality of radially spaced apart spring biased pistons, resiliently biased by a plurality of corresponding radially spaced apart springs, and telescopingly housed in said first plane in corresponding radially spaced apart cylinders in said rotatable label transfer means housing and said cam follower means comprises cam followers, said radially spaced apart cylinders having corresponding radially extending elongate apertures extending through said first bearing surface, and said radially spaced apart pistons having corresponding said earn followers mounted rigidly thereon and extending from said pistons through said elongate apertures in said first beating surface, said cam means comprising a cam surface in said second bearing surface against which are urged said cam followers by said springs, said cam surface constraining said cam followers in a generally circular are so as to maintain said pistons in said retracted label pickup position as said rotatable label transfer means housing is rotated in said first rotational direction so as to rotate a first piston between said first label transfer pickup position and said label deposit point, said cam surface extending radially outward from said generally circular are at said label deposit point whereby said first piston extends radially under the spring biasing three of a corresponding first spring of said springs to said extended label deposit position at said label deposit point.

4. The device of claim 3 wherein said rotation means comprises a drive shaft journalled through said fixed cam surface housing, said drive shaft having rigidly mounted thereon said rotatable label transfer means housing, said drive shall mounted transversely across and above a produce conveyor which moves articles of produce from an upstream position to a downstream position underneath said label deposit point whereby a self adhesive label carried on said exposed end on said fast piston by means of said vacuum communicated through said first vacuum port may be transferred to the surface of said article of produce under said label deposit point by means of said spring biasing force acting on said Fast piston whereby said label is pressed against said surface of said article of produce to thereby adhere said label to said surface, said produce conveyor further comprising an upstream sensor means for detecting whether a sensed article of produce sensed by said sensor means require either a first label from said first selectively actuable label supply means or a second label from said second selectively actuable label supply means, and generating a signal and communicating said signal to either said first or second selectively actuable label supply means so as to actuate either said first selectively actuable label web drive means or said second selectively actuable label web drive means and thereby either said fast label or said second label to said exposed end of said first piston in a timed fashion, whereby rotation of said first or second label on said rotatable label transfer means housing from said first or second label transfer position to said label deposit point coincides with coinciding timed arrival of said sensed article of produce.

5. The device of claim 4 wherein said first and second bearing surfaces are made of Delrin (TM) material.

6. A produce labeller comprising:

first selectively actuable label supply means for selectively supplying labels from said first selectively actuable label supply means to corresponding a first label transfer position in a first plane, a rotatable label transfer means housing, selectively rotatable in said first plane in a first rotational direction by rotation means, said rotatable label transfer means housing having mounted therein in said first plane, a resiliently biased radially telescoping label transfer means for picking up a label from said first selectively actuable label supply means at said first label transfer position and rotationally carrying said label in said first rotational direction from said fast label transfer position to a label deposit point, said label carried on an exposed end of said resiliently biased radially telescoping label transfer means by a selectively actuable vacuum means mounted on said exposed end, cam means in a second plane parallel to said first plane for moving in a radial direction said resiliently biased radially telescoping label transfer metals between a retracted label pick-up position tit said first label transfer position and an extended label deposit position at said label deposit point, said first plane adjacent to said second plane and said resiliently biased radially telescoping label transfer means having cam follower means cooperating with said earn means, wherein said cam means comprises a fixed cam surface housing and said selectively actuable vacuum means comprises a first vacuum port in said exposed end communicating via vacuum communication means with a vacuum plenum in said rotatable label transfer means housing, said rotatable label transfer means housing mounted adjacent said fixed cam surface housing so as to bear a planar first bearing surface on said rotatable label transfer means housing against a planar second bearing surface on said fixed cam surface housing, said vacuum plenum having a vacuum plenum aperture on said first bearing surface, said vacuum plenum aperture cooperating with a vacuum manifold in said fixed cam surface housing, via an arcuate aperture on said second bearing surface, said vacuum plenum aperture corresponding to said arcuate aperture, said arcuate aperture extending between a vacuum initiating point, corresponding to he location of said vacuum plenum aperture when said first vacuum port has been rotated in said first rotational direction on said rotatable label transfer means housing to said first label transfer position, and a vacuum removal point corresponding to when said first vacuum port has been rotated in said first rotational direction on said rotatable label transfer means housing to a point past said label deposit point, whereby, as said rotatable label transfer means housing is rotated by said rotation means in said first rotational direction relative to said fixed cam surface housing, when said first vacuum port is at said first label transfer position said vacuum plenum aperture corresponds to said vacuum initiating position on said arcuate aperture and a vacuum applied to said vacuum manifold is communicated to said first vacuum port and maintained as said rotatable label transfer means housing is rotated in said first rotational direction so as to rotate said first vacuum port from said first label transfer position to said label deposit point, and whereby, as said first vacuum port is rotated in said first rotational direction past said label deposit point, said vacuum plenum aperture is rotated out of corresponding alignment with said vacuum removal point on said arcuate aperture so as to remove communication sad vacuum in said vacuum manifold with said first vacuum port thereby to release a label releasably carried on said exposed end.

7. The device of claim 6 wherein said resiliently biased radially telescoping label transfer means comprise a plurality of radially spaced apart spring biased pistons, resiliently biased by a plurality of corresponding radially spaced apart springs, and telescopingly housed in said first plane in corresponding radially spaced apart cylinders in said rotatable label transfer means housing and said cam follower means comprises cam followers, said radially spaced apart cylinders having corresponding radially extending elongate apertures extending through said first bearing surface, and said radially spaced apart pistons having corresponding said cam followers mounted rigidly thereon and extending from said pistons through said elongate apertures in said first bearing surface, said cam means comprising a cam surface in said second bearing surface against which urged said earn followers by said springs, said cam surface constraining said cam followers in a generally circular arc so as to maintain said pistons in said retracted label pickup position as said rotatable label transfer means housing is rotated in said first rotational direction so as to rotate a first piston between said first label transfer pickup position and said label deposit point, said cam surface extending radially outward from said generally circular are at said label deposit point whereby said first piston extends radially under the spring biasing force of a corresponding first spring of said springs to said extended label deposit position at said label deposit point.

8. The device of claim 7 wherein said rotation means comprises a drive shaft journalled through said fixed cam surface housing, said drive shaft having rigidly mounted thereon said rotatable label transfer means housing, said drive shaft mounted transversely across and above a produce conveyor which moves articles of produce from an upstream position to a downstream position underneath said label deposit point whereby a self-adhesive label carried on said exposed end on said first piston by means of said vacuum communicated through said first vacuum port may be transferred to the surface of said article of produce under said label deposit point by means of said spring biasing force acting on said first piston whereby said label is pressed against said surface of said article of produce to thereby adhere said label to said surface, said produce conveyor further comprising an upstream sensor means for detecting whether a sensed article of produce sensed by said sensor means require either a first label from said first selectively actuable label supply means or a second label from said second selectively actuable label supply means, and generating a signal and communicating said signal to either said first or second selectively actuable label supply means so as to actuate either said first or second selectively actuable label web drive means and thereby either said first label or said second label to said exposed end of said first piston in a timed fashion, whereby rotation of said first or second label on said rotatable label transfer means housing from said first or second label transfer position to said label deposit point coincides with coinciding timed arrival of said sensed article of produce.

9. The device of claim 8 wherein said first and sound bearing surfaces are made of Delrin (TM) material.

10. The device of claims 3 or 7 wherein said cams means further comprises a piston return lever, pivotally mounted on said cam surface, rotatable between a piston retracted position elevated from said cam surface and, against the return biasing force of a piston return lever spring, a cam follower capture position substantially flush with said cam surface, trigger means cooperating between said piston return lever and said rotatable label transfer means housing for rotating said piston return lever between said piston retracted position and said cam follower capture position.

* * * * *